US008948436B2

(12) United States Patent
Stewart, Jr. et al.

(10) Patent No.: US 8,948,436 B2
(45) Date of Patent: Feb. 3, 2015

(54) LOUDSPEAKER SYSTEM

(75) Inventors: William Cameron Stewart, Jr., Raleigh, NC (US); Jeff Hatley, Mebane, NC (US); Michael Hudson, Nashville, NC (US); Larry Frerichs, Raleigh, NC (US)

(73) Assignee: RGB Systems, Inc., Anaheim, CA (US)

( * ) Notice: Subject to any disclaimer, the term of this patent is extended or adjusted under 35 U.S.C. 154(b) by 300 days.

(21) Appl. No.: 13/113,545

(22) Filed: May 23, 2011

(65) Prior Publication Data

US 2012/0300966 A1 Nov. 29, 2012

(51) Int. Cl.
*H04R 1/02* (2006.01)

(52) U.S. Cl.
CPC ..... *H04R 1/026* (2013.01); *H04R 2201/021* (2013.01)
USPC ..... 381/386; 381/394; 381/332; 381/334

(58) Field of Classification Search
CPC ..... H04R 1/02
USPC ..... 381/87, 332, 361, 386, 394, 334
See application file for complete search history.

(56) References Cited

U.S. PATENT DOCUMENTS 4,984,278 A * 1/1991 Frye et al. ..... 381/387
5,048,089 A 9/1991 Moore (Continued)

FOREIGN PATENT DOCUMENTS

DE 9319330 U1 2/1994
EP 2184928 A1 5/2010
GB 2241410 A 8/1991

OTHER PUBLICATIONS

International Searching Authority, Int'l Preliminary Report on Patentability, Aug. 20, 2012, int'l app. No. PCT/US2012/000254.

(Continued)

*Primary Examiner* — Disler Paul
(74) *Attorney, Agent, or Firm* — The Hecker Law Group, PLC

(57) ABSTRACT

The present invention comprises a loudspeaker system that includes a loudspeaker and a detachable mount. In one or more embodiments, the loudspeaker and mount include electrical connectors that are engaged when the loudspeaker is attached to the mount. In one or more embodiments, the loudspeaker and mount comprise mating mounting structures that support the loudspeaker on the mount when the mounting structure of the loudspeaker is engaged with the mounting structure of the mount. In one or more embodiments, mating electrical connectors are incorporated in the mounting structures such that engaging the mounting structures simultaneously engages the electrical connectors. In one or more embodiments, the loudspeaker comprises a locking mechanism that positively retains the loudspeaker on the mount. In one or more embodiments, the locking mechanism is hidden behind a flexible grill of the loudspeaker such that pressing on a corresponding location on the grill releases the locking mechanism allowing the loudspeaker to be detached from the mount. In one or more embodiments, the mount is configured to be mountable to a standard US or European electrical wiring box. In one or more embodiments, the mating mounting structures are configured to be engageable with a reduced amount of travel. In one or more embodiments, multiple configurations of the mount are provided that allow the loudspeaker to be mounted with a variety of orientations with respect to the mounting surface.

15 Claims, 26 Drawing Sheets

(56) References Cited

U.S. PATENT DOCUMENTS

| | | | | |
|---|---|---|---|---|
| 5,185,804 | A * | 2/1993 | Watanabe | 381/86 |
| 5,704,578 | A | 1/1998 | Fischer | |
| 5,900,715 | A * | 5/1999 | Roberts | 320/115 |
| 5,970,161 | A | 10/1999 | Takashima | |
| 6,467,745 | B1 | 10/2002 | Sickels | |
| 7,349,551 | B2 | 3/2008 | Skillicorn et al. | |
| 7,639,825 | B2 * | 12/2009 | Fukuda | 381/151 |
| 7,804,966 | B2 * | 9/2010 | Adams et al. | 381/87 |
| 2003/0174855 | A1 | 9/2003 | Hawkins et al. | |
| 2005/0281429 | A1 * | 12/2005 | Rivera | 381/391 |
| 2007/0040085 | A1 | 2/2007 | Pincek | |
| 2009/0034771 | A1 * | 2/2009 | Gleissner et al. | 381/332 |
| 2011/0200220 | A1 * | 8/2011 | Wright | 381/332 |

OTHER PUBLICATIONS

European Patent Office, Supplementary European Search Report, Nov. 13, 2014, App. No. EP 12 78 9123.

* cited by examiner

LOUDSPEAKER SYSTEM

BACKGROUND OF THE INVENTION (1) Field of the Invention

The present invention relates to a loudspeaker system comprising a loudspeaker and a detachable mount.

(2) Background of the Invention

It is often desired to mount loudspeakers to walls, ceilings, or other surfaces at locations that are remote from the source of the electrical audio signals that are to be emitted from the loudspeakers. For appearance purposes, it is desirable that the speaker wires connecting the loudspeakers to their audio source (such as, for example, an amplifier or surround-sound system) are not visible. One way to achieve such invisibility is to run the speaker wires through walls. In some cases, structured wiring systems may have been installed in a building's walls that can be used to transmit the audio from the source to the speakers. In other cases, in-wall wiring can be retrofitted to a building.

In-wall wiring typically terminates at an electrical junction box that is accessible through a corresponding opening that is created in the wall material. A wall plate is typically mounted to the electrical box to cover the wall opening. For speaker wire applications, the wall plate typically includes connectors on the outside of the plate that are electrically connected to the in-wall wires. Typical connectors include banana plugs, spring clips, and screw terminals. Wires are typically run from the wall plate connectors to terminals on the loudspeaker housing. Accordingly, although the bulk of the wiring from the audio source to the loudspeakers may be hidden inside the walls, the portions running from the wall plate to the loudspeaker remain visible. Further, if it is desired to mount the loudspeaker on a wall or other surface, several steps must be performed: a loudspeaker mount must be attached to the wall, the loudspeaker must be attached to the mount, and wires must be run from the wall plate to the loudspeaker.

It is desirable to have a loudspeaker system that allows convenient and secure mounting of the loudspeaker to a wall plate and that eliminates unsightly exposed speaker wires.

BRIEF SUMMARY OF THE INVENTION

The present invention comprises a loudspeaker system that includes a loudspeaker and a detachable mount. In one or more embodiments, the loudspeaker and mount include electrical connectors that are engaged when the loudspeaker is attached to the mount. In one or more embodiments, the loudspeaker and mount comprise mating mounting structures that support the loudspeaker on the mount when the mounting structure of the loudspeaker is engaged with the mounting structure of the mount. In one or more embodiments, mating electrical connectors are incorporated in the mounting structures such that engaging the mounting structures simultaneously engages the electrical connectors. In one or more embodiments, the loudspeaker comprises a locking mechanism that positively retains the loudspeaker on the mount. In one or more embodiments, the locking mechanism is hidden behind a flexible grill of the loudspeaker such that pressing on a corresponding location on the grill releases the locking mechanism allowing the loudspeaker to be detached from the mount. In one or more embodiments, the mount is configured to be mountable to a standard US or European electrical wiring box. In one or more embodiments, the mating mounting structures are configured to be engageable with a reduced amount of travel. In one or more embodiments, multiple configurations of the mount are provided that allow the loudspeaker to be mounted with a variety of orientations with respect to the mounting surface.

BRIEF DESCRIPTION OF THE DRAWINGS

The present invention may be understood and its features made apparent to those skilled in the art by referencing the accompanying drawings.

DETAILED DESCRIPTION OF THE INVENTION

Figure 1:
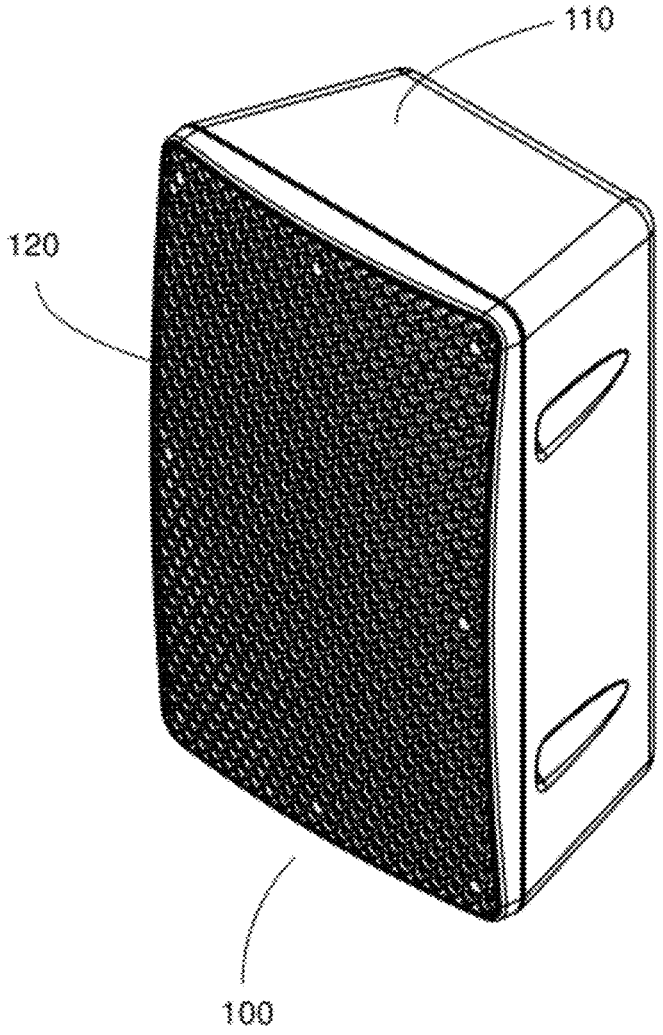
FIG. 1 is a front perspective view of an embodiment of a loudspeaker of the present invention.
Figure 2:
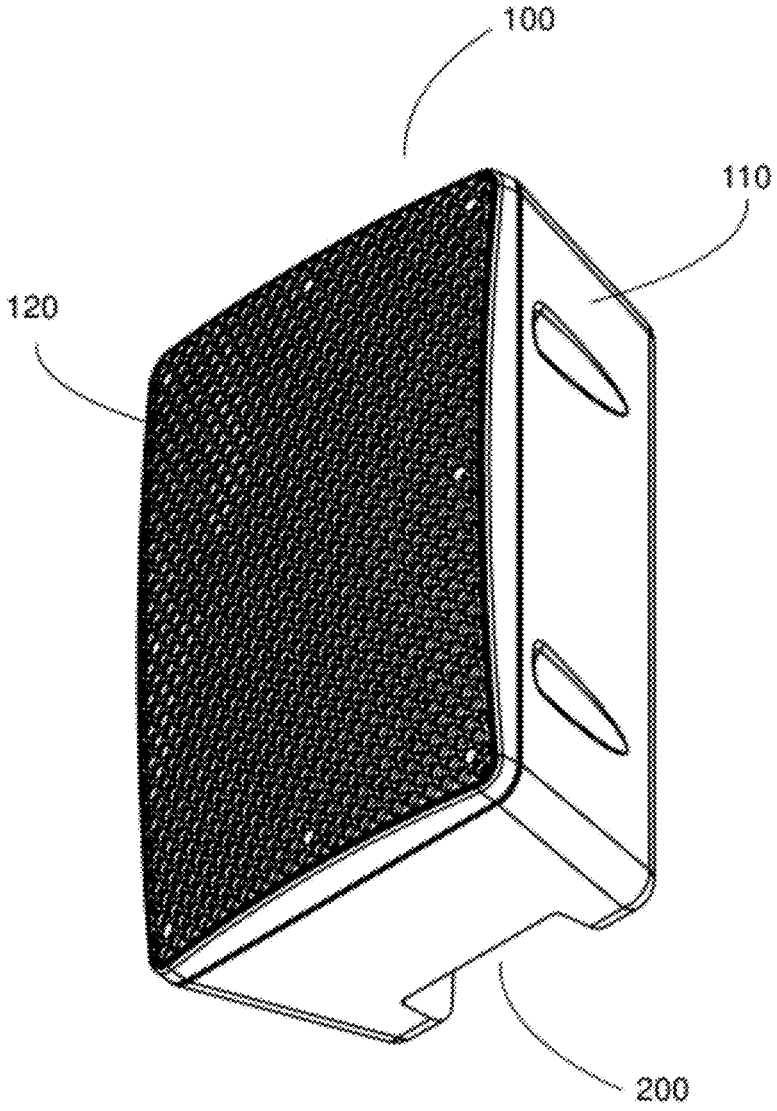
FIG. 2 is a front perspective view of an embodiment of a loudspeaker of the present invention.
Figure 3:
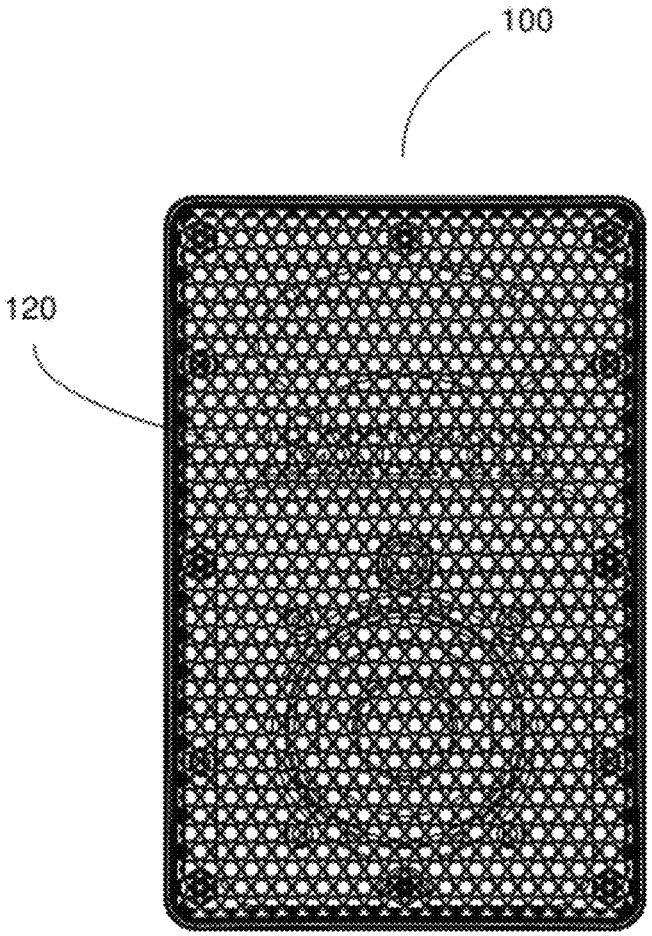
FIG. 3 is a front view of an embodiment of a loudspeaker of the present invention.
Figure 4:
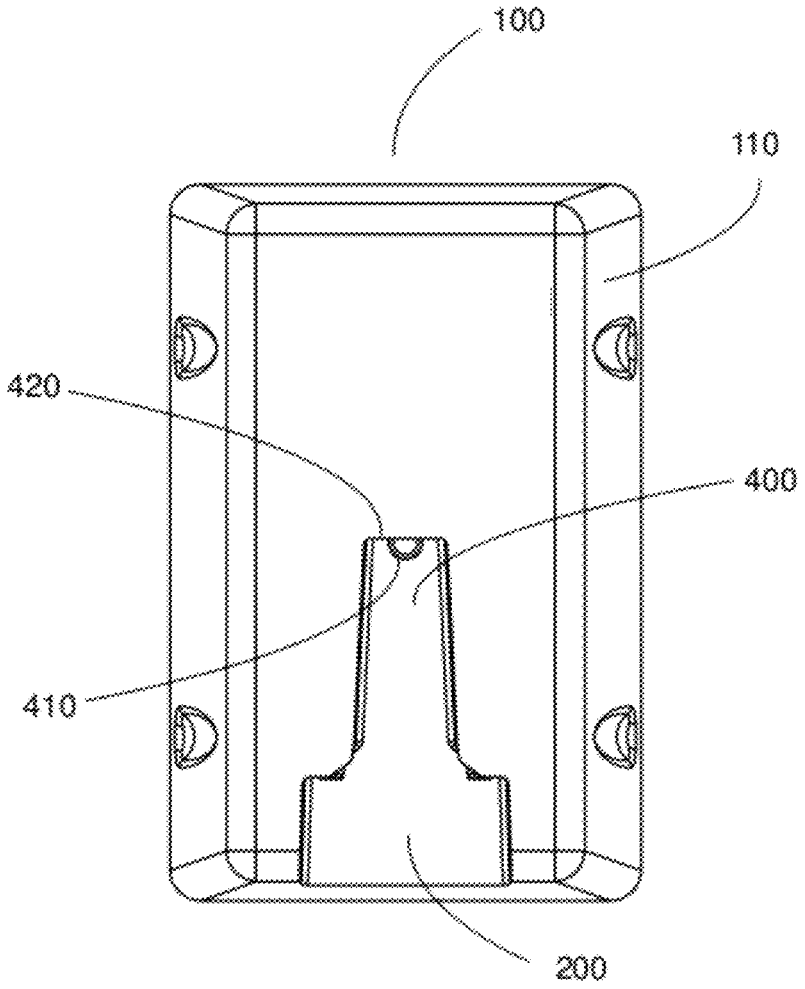
FIG. 4 is a rear view of an embodiment of a loudspeaker of the present invention.
Figure 5:
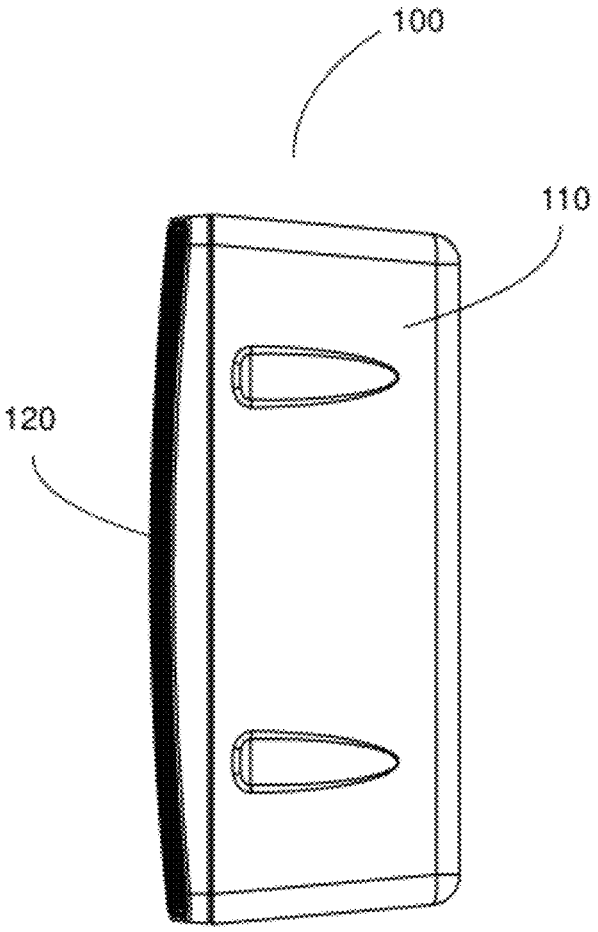
FIG. 5 is a side view of an embodiment of a loudspeaker of the present invention.
Figure 6:
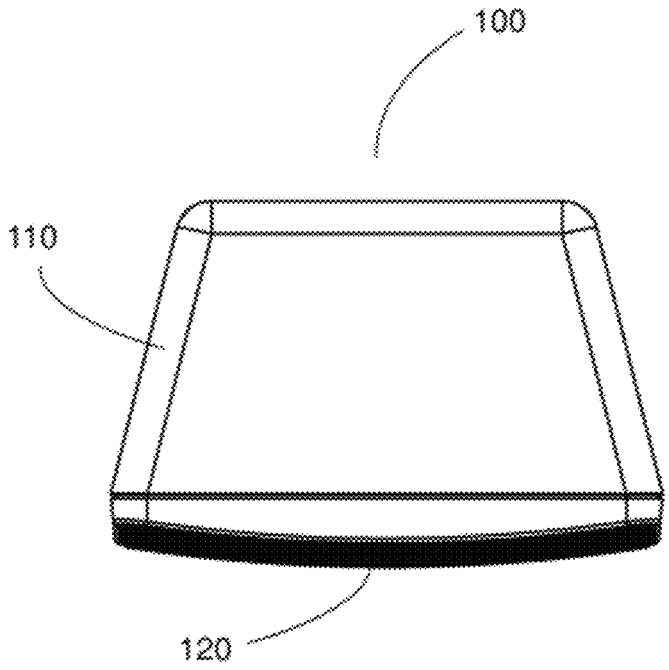
FIG. 6 is a top view of an embodiment of a loudspeaker of the present invention.
Figure 7:
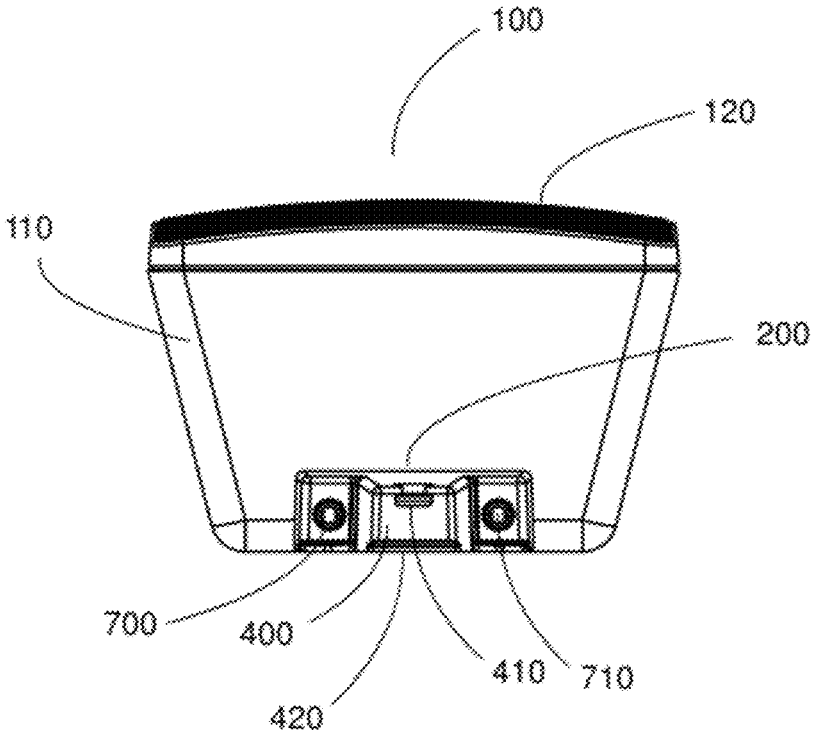
FIG. 7 is a bottom view of an embodiment of a loudspeaker of the present invention.
Figure 8:
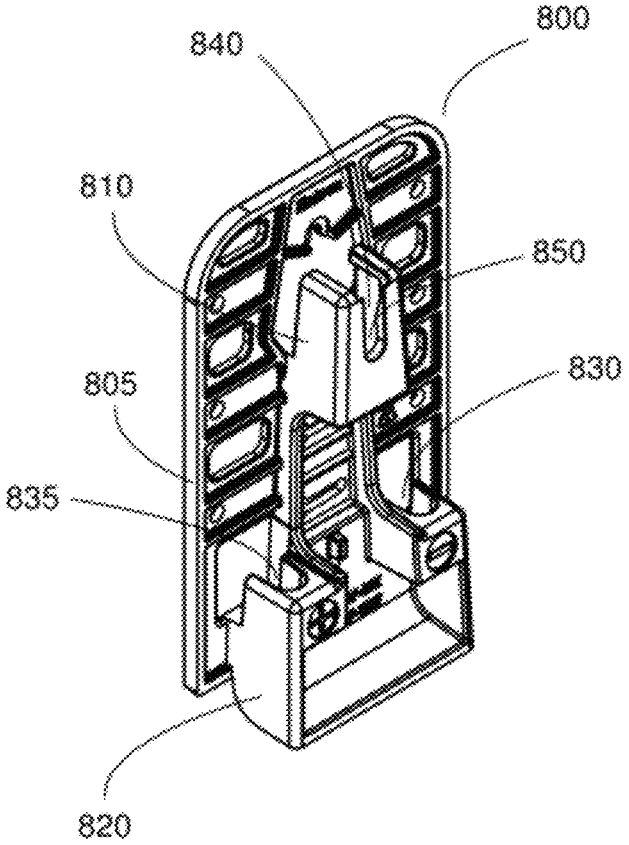
FIG. 8 is a perspective view of an embodiment of a speaker mount of the present invention.

FIGS. 1 to 7 illustrate a loudspeaker 100 in accordance with one or more embodiments of the invention. In the embodiment shown in FIG. 1, loudspeaker 100 includes a speaker housing 110 and a grille 120. Speaker housing 110 and grille 120, as well as the internal structure and configuration of loudspeaker 100, are not critical and can be of any form, shape, and material as may be known in the art. In the embodiment shown in FIG. 2, housing 110 includes a recessed mounting channel 200 that is part of a mounting structure for mounting loudspeaker 100 to a mating speaker mount. In the embodiment shown in FIG. 4, mounting channel 200 includes a channel neck 400, a locking pin 410, and a mounting lip 420. In the embodiment shown in FIG. 7, mounting channel 200 includes conducting elements 700 and 710 that are configured to engage and provide electrical contact to corresponding conducting elements in a mating speaker mount.

FIGS. 8 to 13 illustrate a speaker mount 800 in accordance with one or more embodiments of the invention. In one or more embodiments, speaker mount 800 is configured to attach to loudspeaker 100 and to a standard electrical junction box (not shown). In the embodiment shown in FIG. 8, speaker mount 800 includes a rear portion 805 and a mounting structure portion extending outwards from rear portion 805 that includes a lower support portion 820 and an upper support portion 810. Lower support portion 820 and upper support portion 810 are configured to engage, for example, recessed mounting channel 200 of loudspeaker 100. In the embodiment shown in FIG. 8, upper support portion 810 includes a slot 840 that is configured to accept locking pin 410 of loudspeaker 100 when loudspeaker 100 is mounted to speaker mount 800. In one or more embodiments, slot 840 includes a locking recess 850 that positively engages the head of locking pin 410 when loudspeaker 100 is fully seated on speaker mount 800. In the embodiment shown in FIG. 8, lower support portion 820 includes socket portions 830 and 835 that contain conducting elements that are configured to mate with conducting elements 700 and 710 of loudspeaker 100 when loudspeaker 100 is mounted to speaker mount 800.

Figure 9:
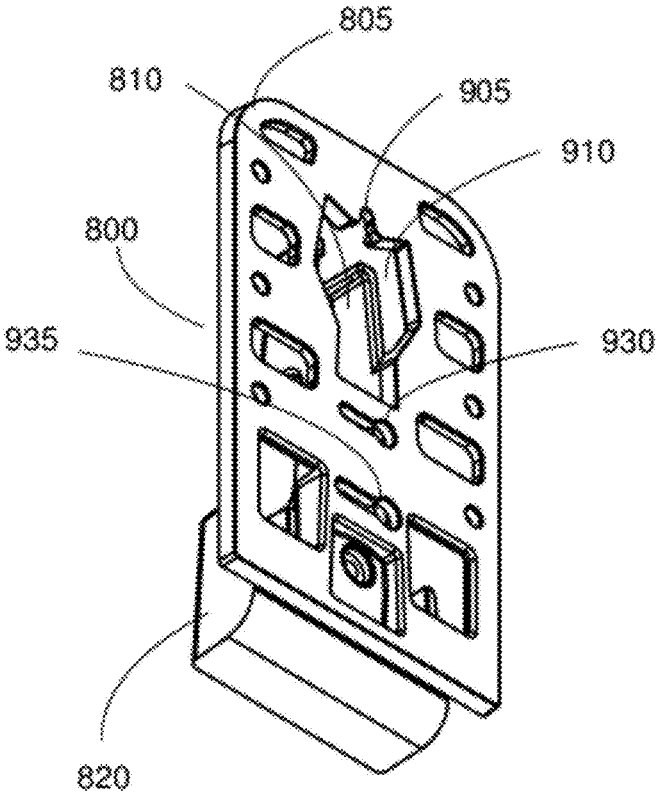
FIG. 9 is a perspective view of an embodiment of a speaker mount of the present invention.
Figure 10:
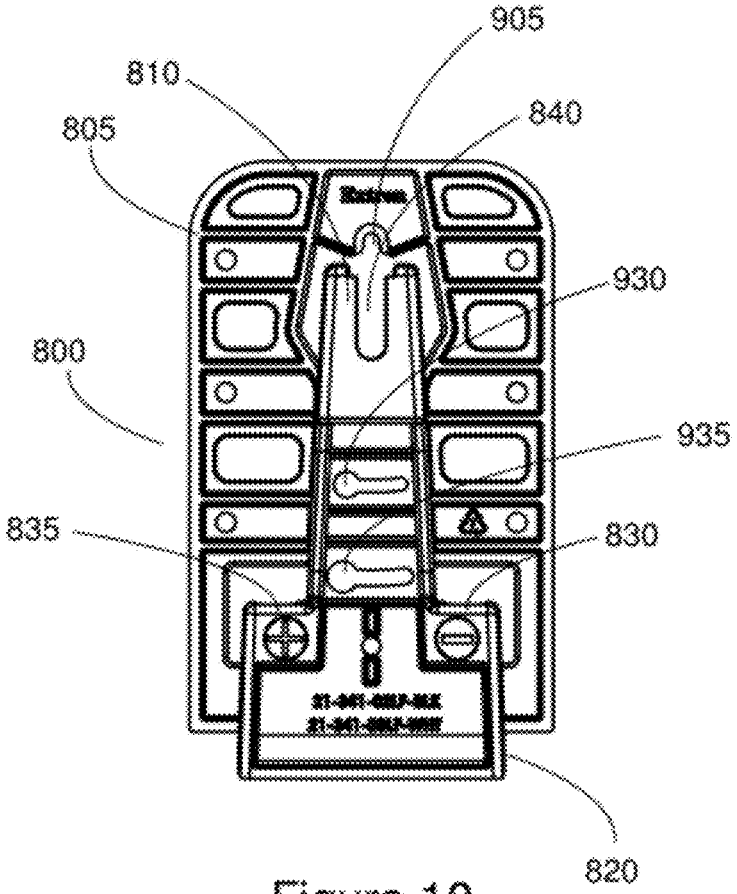
FIG. 10 is a front view of an embodiment of a speaker mount of the present invention.

In the embodiments shown in FIGS. 9 and 10, rear portion 805 of speaker mount 800 includes a number of orifices. Those orifices include an upper orifice 910 that includes an upper screw recess 905 and lower screw orifices 930 and 935. In one or more embodiments, lower screw orifices 930 and 935 are configured as slots that allow a degree of positional adjustment of speaker mount 800 with respect to an electrical junction box to which speaker mount 800 is mounted. In one or more embodiments, upper screw orifice 905 and lower screw orifice 930 are configured to correspond to the spacing of cover plate attachment screws for a first size of a standard electrical junction box (e.g. a standard metric electrical junction box that has 60 mm attachment screw spacing), while upper screw recess 905 and lower screw orifice 935 are configured to correspond to the spacing of cover plate attachment screws for a second size of a standard electrical junction box (e.g. a standard U.S. electrical junction box that has 3.25 inch attachment screw spacing).

Figure 11:
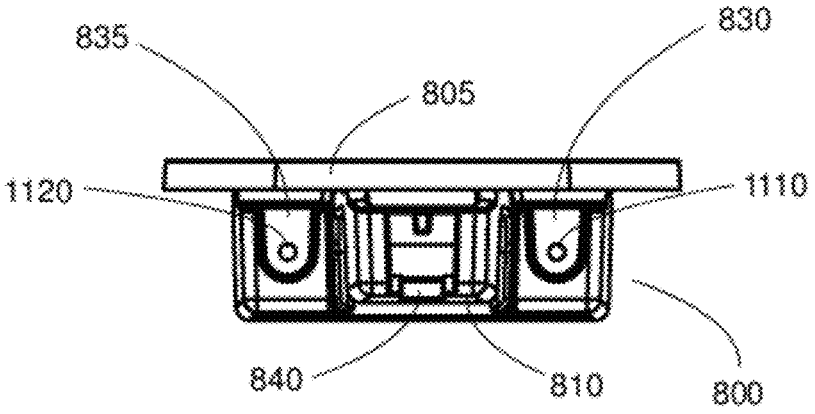
FIG. 11 is a top view of an embodiment of a speaker mount of the present invention.
Figure 12:
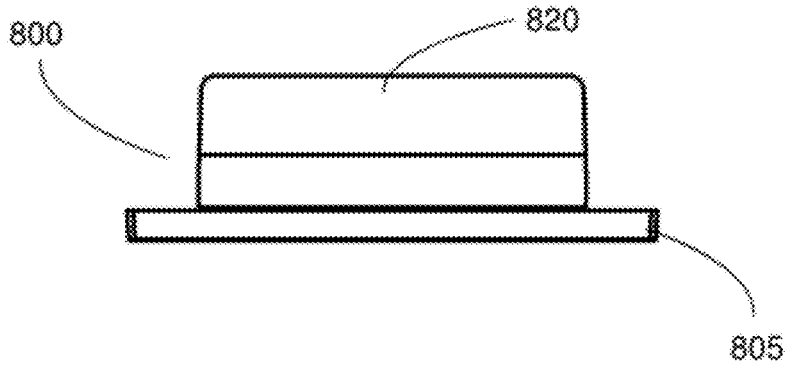
FIG. 12 is a bottom view of an embodiment of a speaker mount of the present invention.

In the embodiment shown in FIG. 11, socket portions 830 and 835 of speaker mount 800 include conducting elements 1110 and 1120 that are configured to engage conducting elements 700 and 710 of loudspeaker 100 when loudspeaker 100 is mounted to speaker mount 800. Conducting elements 700, 710, 1110 and 1120 can be any type of mating conducting elements. In one or more embodiments, conducting elements 700, 710, 1110 and 1120 comprise standard electrical connectors, for example, mating pin and socket Molex connectors.

Figure 13:
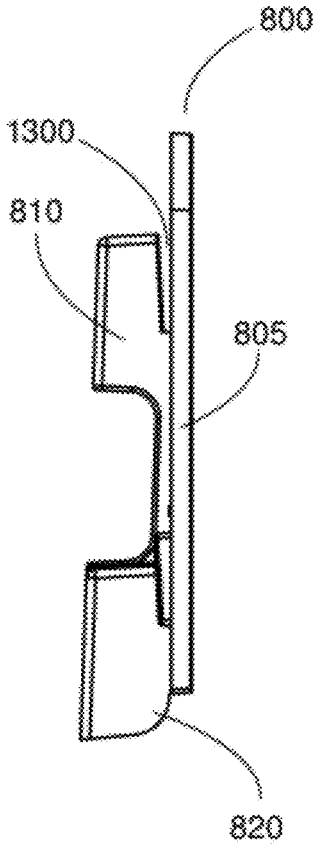
FIG. 13 is a side view of an embodiment of a speaker mount of the present invention.
Figure 14:
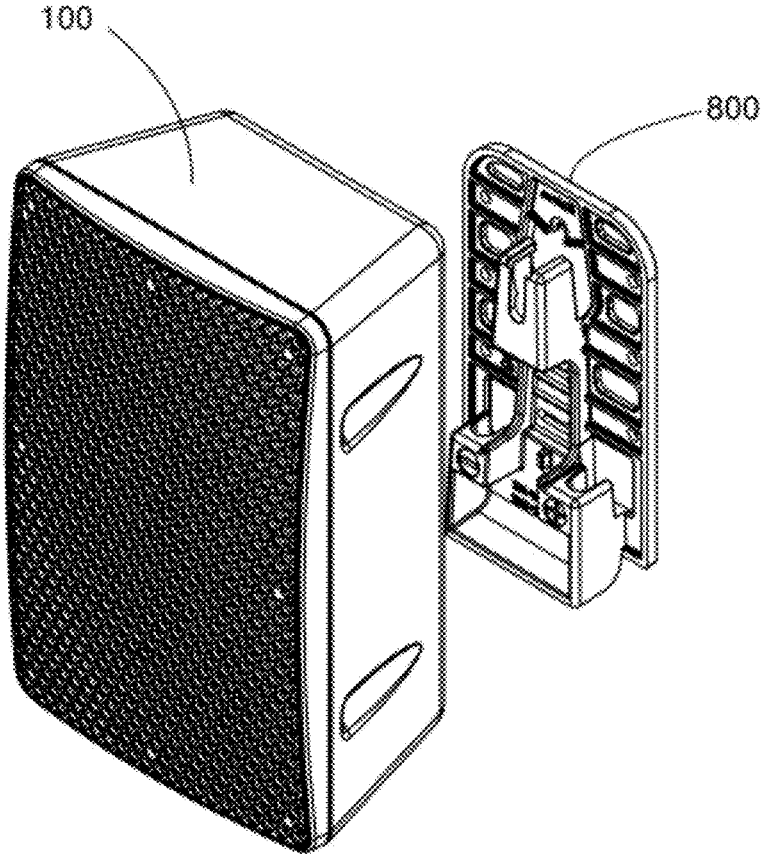
FIG. 14 is a perspective view of an embodiment of a loudspeaker and a speaker mount of the present invention.

In the embodiment shown in FIG. 13, upper support portion 810 of speaker mount 800 includes a tapered gap 1300 between upper support portion 810 and rear portion 805. In one or more embodiments, gap 1300 is configured to accept mounting lip 420 of loudspeaker 100 when loudspeaker 100 is mounted to speaker mount 800.

Figure 15A:
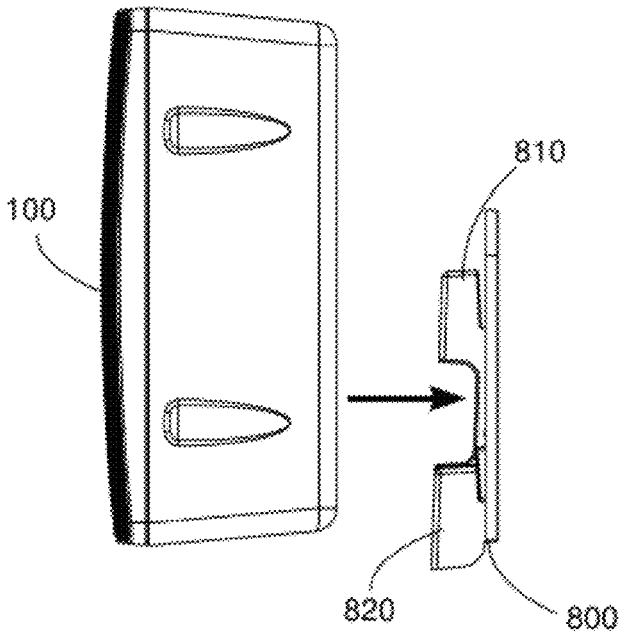
FIG. 15*a* is a side view of an embodiment of a loudspeaker and a speaker mount of the present invention.
Figure 15B:
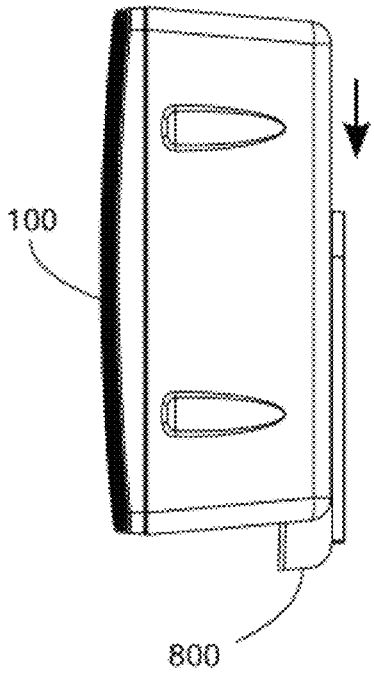
FIG. 15*b* is a side view of an embodiment of a loudspeaker and a speaker mount of the present invention.
Figure 15C:
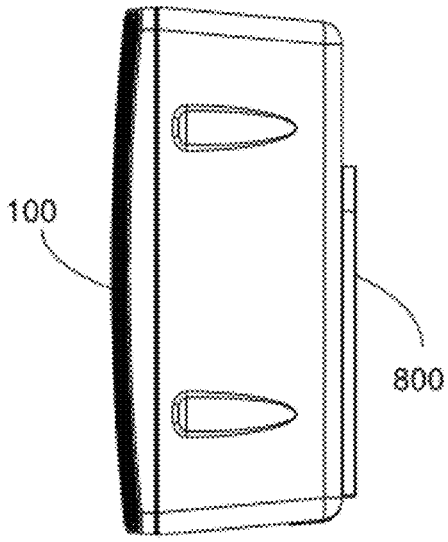
FIG. 15*c* is a side view of an embodiment of a loudspeaker and a speaker mount of the present invention.
Figure 16:
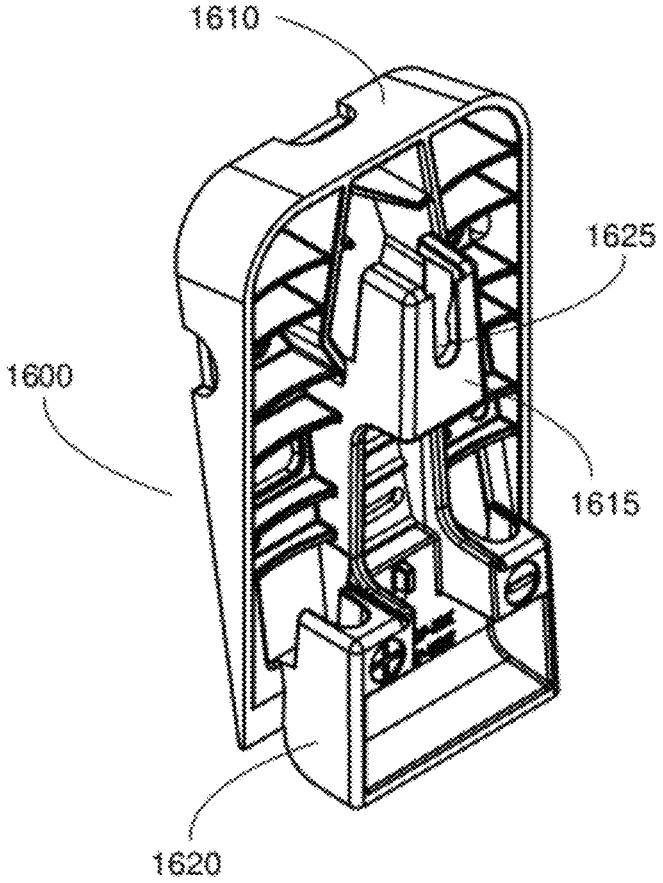
FIG. 16 is a perspective view of an embodiment of a speaker mount of the present invention.

FIGS. 14 and 15*a*, 15*b* and 15*c* illustrate how loudspeaker 100 is mounted to speaker mount 800 according to one or more embodiments of the invention. In the embodiment shown in FIG. 15*a*, loudspeaker 100 is lined up such that the top of upper support portion 810 of speaker mount 800 is below mounting lip 420 of mounting channel 200 of loudspeaker 100 such that upper and lower support portions 810 and 820 of speaker mount 800 engage mounting channel 200 of loudspeaker 100 when loudspeaker 100 is moved horizontally towards speaker mount 800. In the embodiment shown in FIG. 15*b*, once loudspeaker 100 is positioned such that upper and lower support portions 810 and 820 of speaker mount 800 are engaged within mounting channel 200 of speaker mount 800, loudspeaker 100 is moved vertically downwards with respect to speaker mount 800 until loudspeaker 100 is fully seated on speaker mount 800, as shown in FIG. 15*c*. As is apparent from FIG. 15*c*, because mounting channel 200 is recessed into the housing of loudspeaker 100, when loudspeaker 100 is seated on speaker mount 800, there is only a small separation between the rear of loudspeaker 100 and the mounting surface. Having such a recessed mounting channel allows loudspeaker 100 to be mounted close to the mounting surface, such that the distance that the front of loudspeaker 100 extends from the mounting surface is not much more than the depth of loudspeaker 100 itself, thereby facilitating compliance with building codes (such as, for example, the Americans with Disabilities Act) that limit the distance that objects may extend outwards from inside building walls.

In one or more embodiments, when loudspeaker 100 is fully seated on speaker mount 800, mounting lip 420 of mounting channel 200 of loudspeaker 100 is seated in tapered gap 1300 of speaker mount 800, locking pin 410 of loudspeaker 100 engages locking recess 850 of slot 840 of speaker mount 800, and conducting elements 700 and 710 of loudspeaker 100 are in electrical contact with conducting elements 1110 and 1120 of speaker mount 800. In one or more embodiments, mounting channel 200 of loudspeaker 100 and upper and lower support portions 810 and 820 of speaker mount 800 are configured such that the amount of vertical travel needed for loudspeaker 100 to engage speaker mount 800 (and hence the minimum clearance required above loudspeaker 100 when mounted to speaker mount 800) is approximately an inch.

Figure 22:
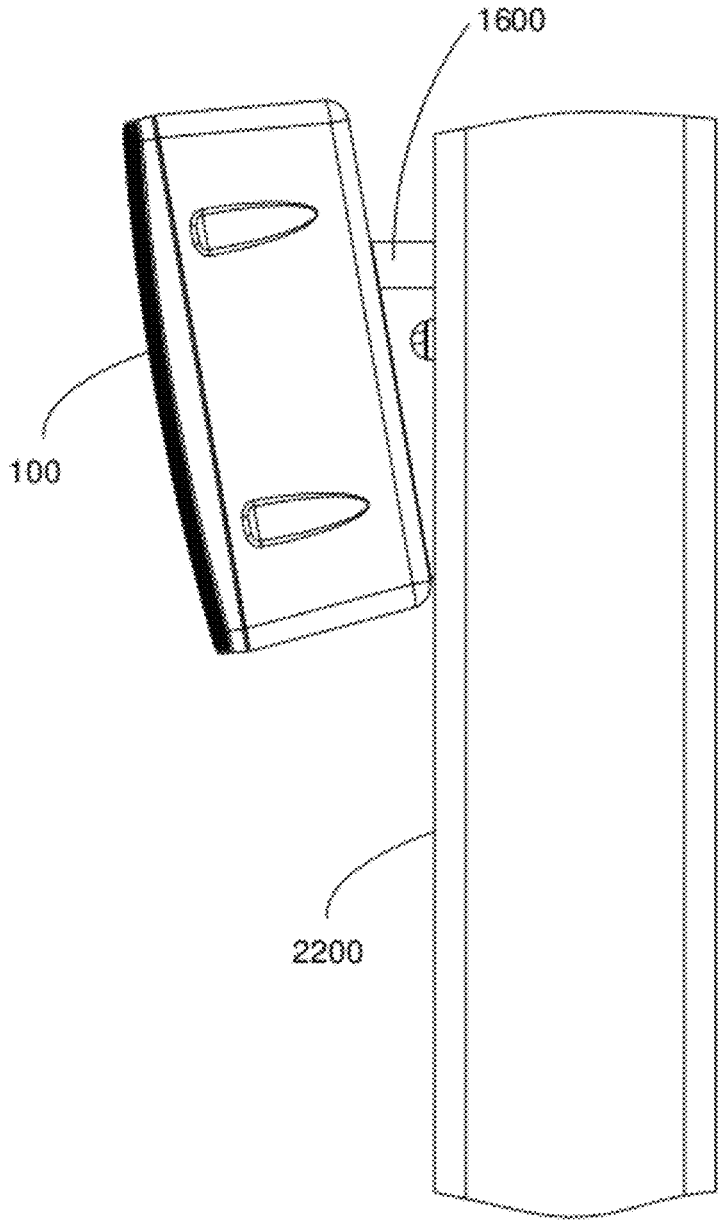
FIG. 22 is a side view of an embodiment of a loudspeaker and a speaker mount of the present invention.

FIGS. 16 to 21 show an embodiment of an angled speaker mount 1600 of the invention. In one or more embodiments, angled speaker mount 1600 is configured to maintain a loudspeaker at an angle with respect to the mounting surface, such as a wall. In the embodiment shown in FIGS. 16 to 21, angled speaker mount 1600 is configured to maintain loudspeaker 100 at an angle of approximately 10 degrees with respect to a mounting surface, as shown, for example, in FIG. 22. However, angled speaker mount 1600 can be configured to maintain loudspeaker 100 at any other angle. In one or more embodiments, angled speaker mount 1600 is configured to allow the angle of loudspeaker 100 to be varied by incorporating, for example, a hinged plate, or by use of adapter plates each of which increases the angle by a specified amount.

Figure 17:
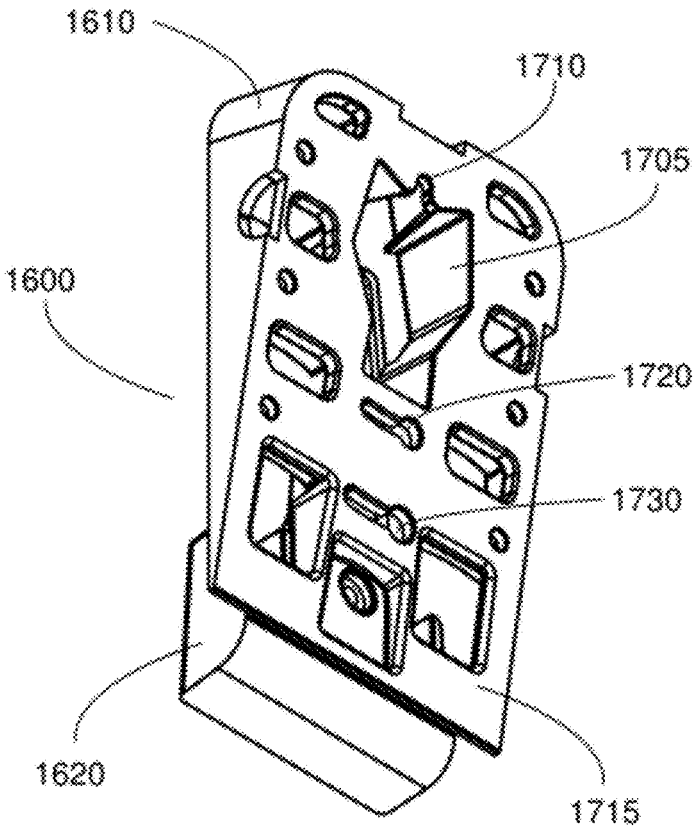
FIG. 17 is a perspective view of an embodiment of a speaker mount of the present invention.
Figure 18:
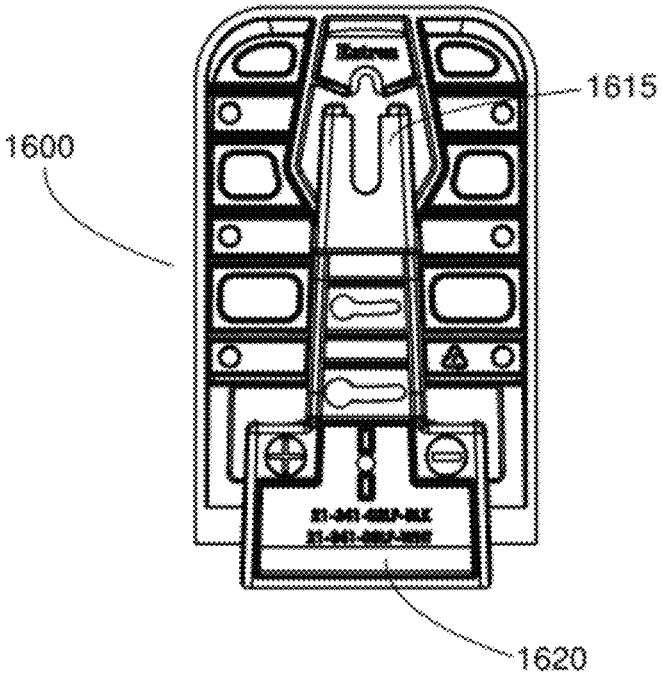
FIG. 18 is a front view of an embodiment of a speaker mount of the present invention.
Figure 19:
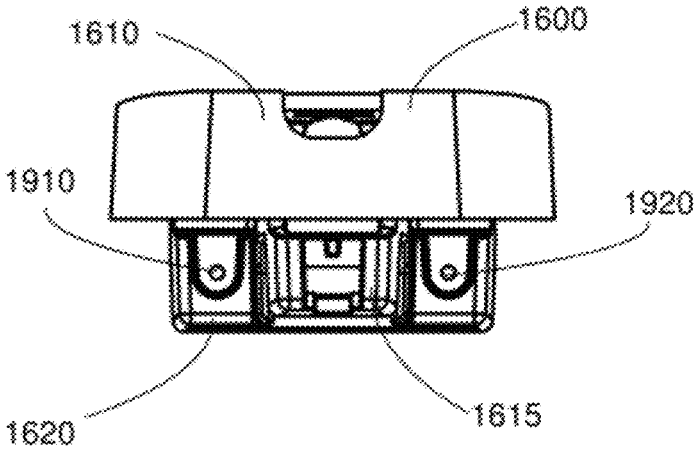
FIG. 19 is a top view of an embodiment of a speaker mount of the present invention.
Figure 20:
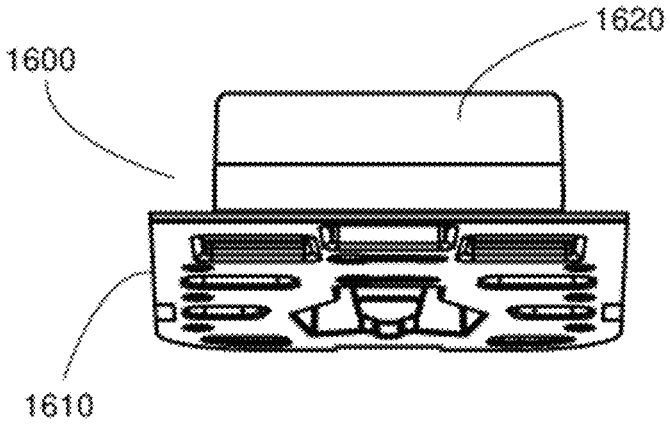
FIG. 20 is a bottom view of an embodiment of a speaker mount of the present invention.
Figure 21:
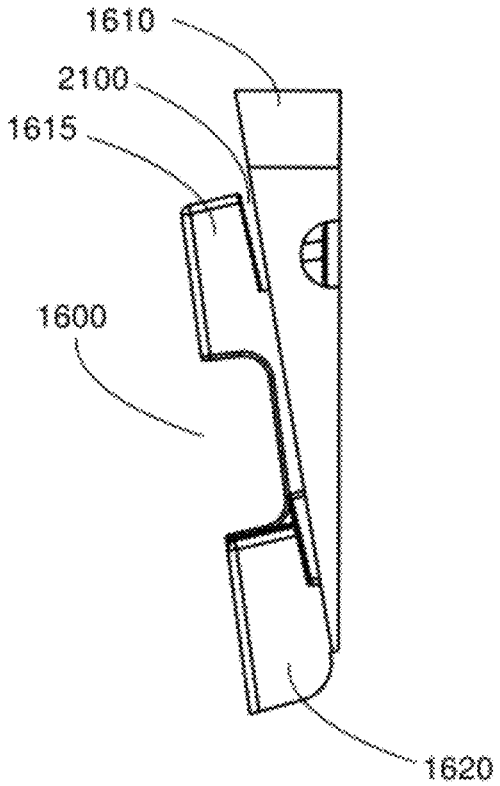
FIG. 21 is a side view of an embodiment of a speaker mount of the present invention.

In the embodiments shown in FIGS. 16 to 21, angled speaker mount 1600 includes a wedge-shaped rear portion 1610 and upper and lower support portions 1615 and 1620. Wedge-shaped rear portion 1610 maintains upper and lower support portions 1615 and 1620, respectively, at an angle with respect to a mounting surface. Upper and lower support portions 1615 and 1620 have the same general configuration as upper and lower support portions 810 and 820 of speaker mount 800, and are configured to engage mounting channel 200 of loudspeaker 100, and mount to loudspeaker 100, in the same manner as speaker mount 800. As shown in FIG. 17, in one or more embodiments, wedge-shaped rear portion 1610 comprises a number of orifices on rear mounting face 1715. In one or more embodiments, the orifices include an upper orifice 1705 comprising an upper screw orifice 1710 and lower screw orifices 1720 and 1730, which have the same general configuration as upper orifice 910, upper screw orifice 905, and lower screw orifices 930 and 935 of speaker mount 800 of FIG. 9. In the embodiment shown in FIG. 21, angled speaker mount 1600, like speaker mount 800 shown in FIG. 13, includes a tapered slot 2100 for engaging mounting lip 420 of loudspeaker 100 when loudspeaker 100 is seated on angled speaker mount 1600.

Figure 23:
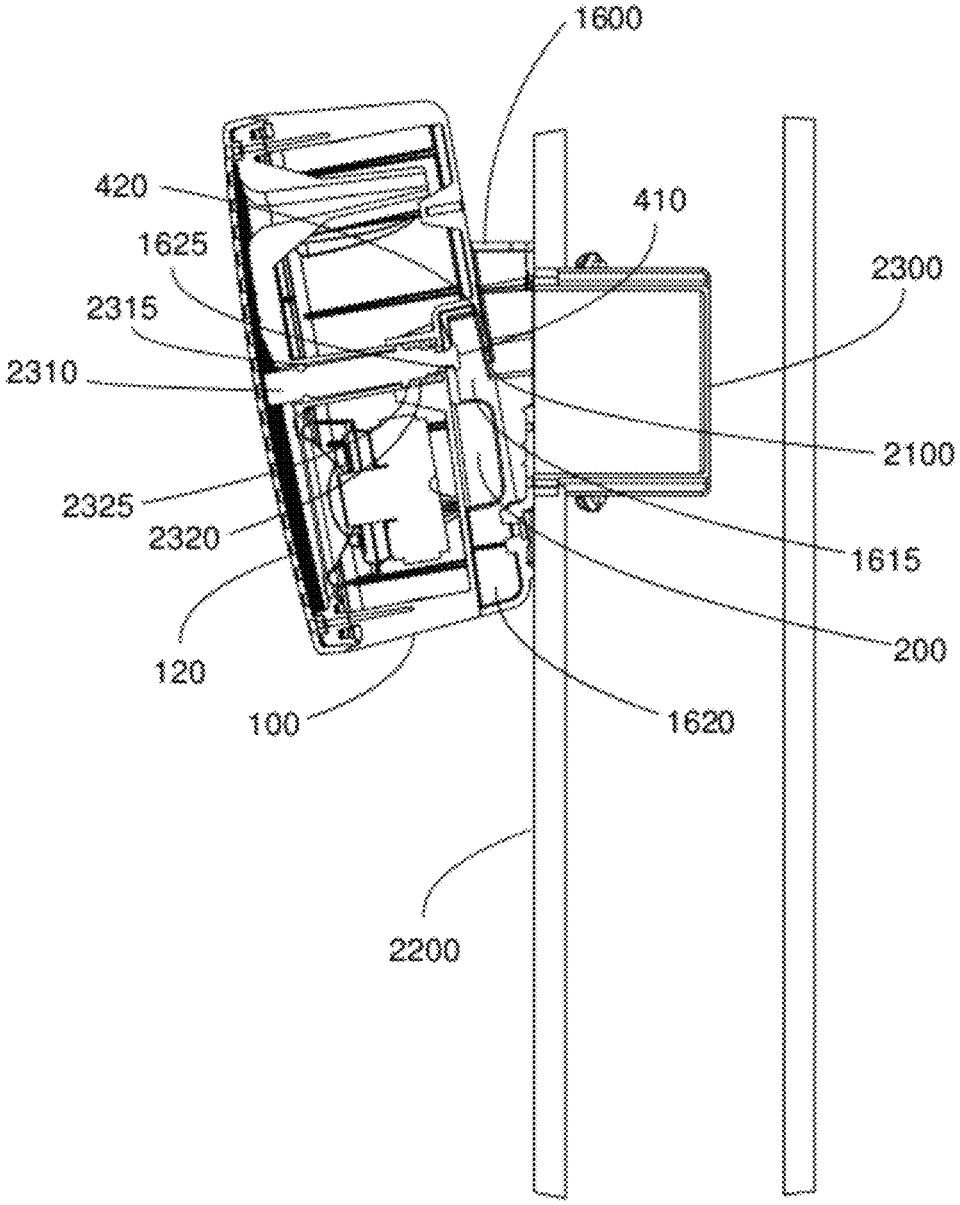
FIG. 23 is a sectional side view of an embodiment of a loudspeaker and a speaker mount of the present invention.

FIG. 23 is a sectional view of an embodiment of speaker 100 mounted to an angled speaker mount 1600, which in turn is mounted to a junction box 2300 mounted in a wall 2200. As shown in FIG. 23, when speaker 100 is fully seated on angled speaker mount 1600, mounting lip 420 of loudspeaker 100 is disposed within tapered slot 2100 of angled speaker mount 1600, lower support portion 1620 of angled speaker mount 1600 is disposed in mounting channel 200 of loudspeaker 100, and locking pin 410 of loudspeaker 100 is engaged in locking recess 1625 of upper support portion 1615 of angled speaker mount 1600. In addition, conducting elements 700 and 710 of loudspeaker 100 are in electrical contact with conducting elements 1910 and 1920 of speaker mount 1600.

In the embodiment of FIG. 23, locking pin 410 is part of a locking mechanism that includes a plunger 2310 disposed in a channel 2315 formed in loudspeaker 100. The end of plunger 2310 opposite from locking pin 410 is disposed inside loudspeaker housing 110 behind grille 120 so that it is "hidden" in the sense that the locking mechanism is disposed behind grille 120. A spring 2320 (for example, a coil spring) that engages a shoulder 2325 on plunger 2310 biases plunger 2310 towards its recessed (retracted) position. In its retracted position, there is clearance between plunger 2310 and grille 120. In one or more embodiments, grille 120 is sufficiently flexible such that pressing on grille 120 adjacent to the position of plunger 2310 causes grille 120 to deform so as to contact and push plunger 2310 away from its retracted position against the bias exerted by spring 2320. If loudspeaker 100 is engaged on a speaker mount, pushing on grille 120 disengages locking pin 410 from the corresponding locking recess of the speaker mount, allowing loudspeaker 100 to be disengaged from the speaker mount. In one or more embodiments, grille 120 is formed from a flexible, resilient plastic material, which allows it to have a domed shape yet be sufficiently deformable so as to be able to contact and push plunger 2310 as described above and return to its original shape when released. In one or more embodiments, the grille is molded from a polycarbonate/ABS blend. However, any other materials capable of being formed into a grille may be used, as will be known to those of skill in the art. In one or more embodiments, the grille comprises a pattern of 3/16 inch diameter holes on staggered centers that provides approximately 51% of free area, and that is similar in appearance to grilles often used in ceiling vents.

Figure 24:
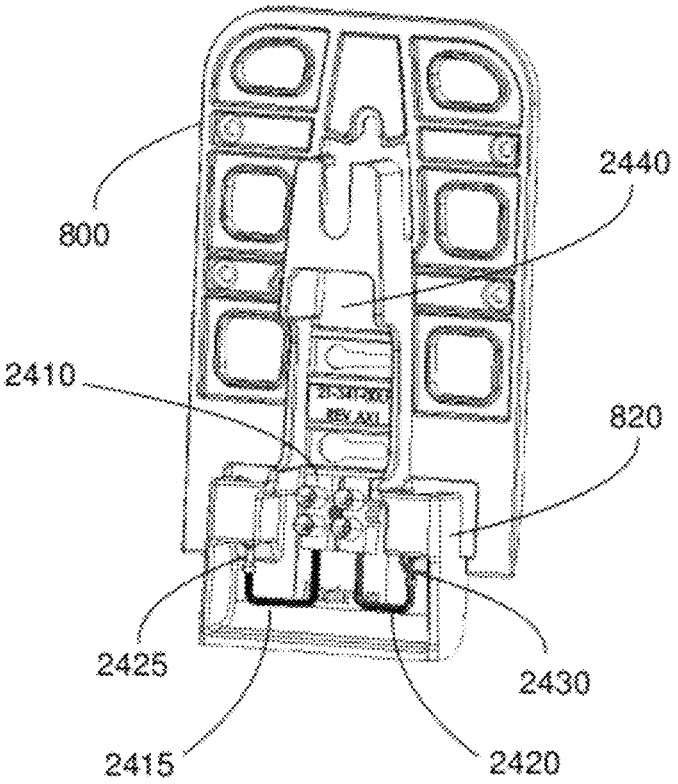
FIG. 24 is a perspective view of an embodiment of a speaker mount of the present invention.

FIG. 24 shows electrical connections for the speaker wires for a speaker mount 800 in one or more embodiments of the invention. In the embodiment of FIG. 24, a European type terminal block 2410 is attached to speaker mount 800, for example, by one or more screws or rivets. Two wires, 2415 and 2420, each with an electrical connector (for example a Molex™ or similar connector) 2425 and 2430, respectively, are connected to the lower two terminals of terminal block 2410. Electrical connectors 2425 and 2430 are inserted into corresponding holes in lower support portion 820, and lock into place by means of metal tab portions on the sides of the connectors, as is known in the art. When mounted to an electrical junction box, in-wall speaker wires may be threaded through orifice 2440 and connected to the upper two terminals of terminal block 2410, thereby creating an electrical connection to connectors 2425 and 2430, which contact corresponding electrical connectors of a loudspeaker 100 when loudspeaker 100 is mounted to speaker mount 800.

Figure 25:
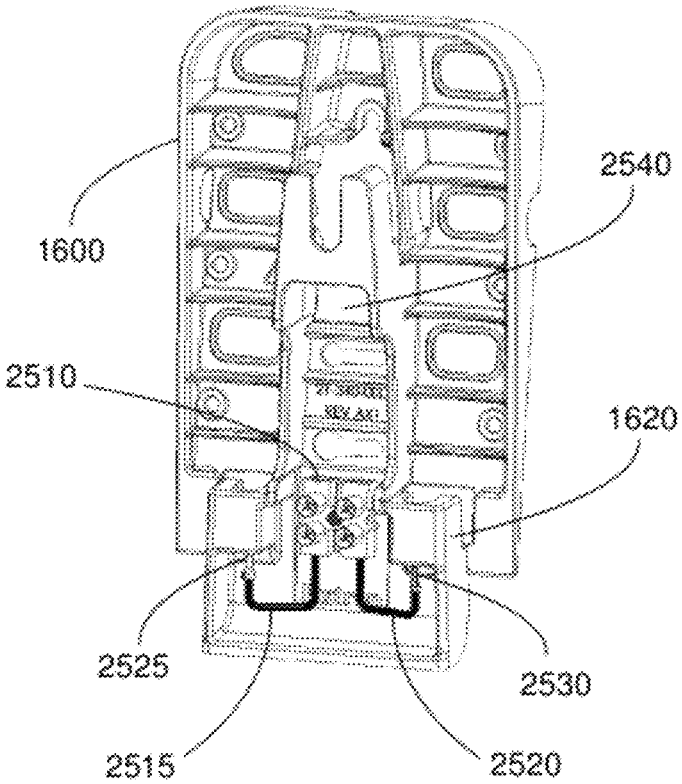
FIG. 25 is a perspective view of an embodiment of a speaker mount of the present invention.

FIG. 25 shows electrical connections for the speaker wires for an angled speaker mount 1600 in one or more embodiments of the invention Like the embodiment of FIG. 24, in the embodiment of FIG. 25, a European type terminal block 2510 is attached to angled speaker mount 1600, for example, by one or more screws or rivets. Two wires, 2515 and 2520, each with an electrical connector (for example a Molex™ or similar connector) 2525 and 2530, respectively, are connected to the lower two terminals of terminal block 2510. Electrical connectors 2525 and 2530 are inserted into corresponding holes in lower support portion 1620, and lock into place by means of metal tab portions on the sides of the connectors, as is known in the art. When mounted to an electrical junction box, in-wall speaker wires may be threaded through orifice 2540 and connected to the upper two terminals of terminal block 2510, thereby creating an electrical connection to connectors 2525 and 2530, which contact corresponding electrical connectors of a loudspeaker 100 when loudspeaker 100 is mounted to speaker mount 800.

Figure 26:
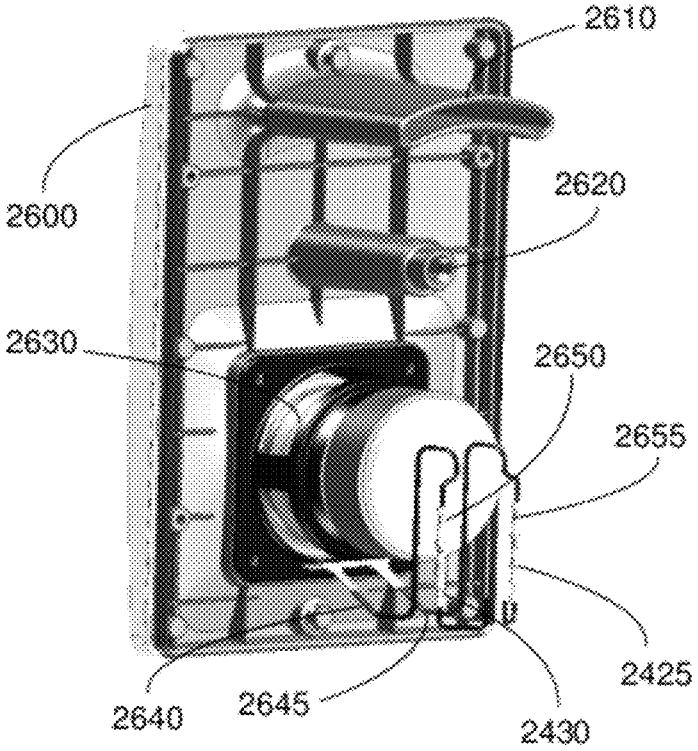
FIG. 26 is a cut-away view of an embodiment of a loudspeaker of the present invention.

FIG. 26 shows the internal wiring of a loudspeaker 100 according to one or more embodiments of the invention. In FIG. 26, the rear portion of housing 110 is not shown so that portions of the internal structure of loudspeaker 100 are visible. FIG. 26 shows a front portion 2600 of a speaker housing that includes a speaker port 2610, a locking plunger channel 2620, and a speaker driver 2630 mounted to front portion 2600. Speaker wires 2640 and 2645 are each attached to the electrical terminals of speaker driver 2630 at one end and to electrical connectors (for example Molex™ or similar connectors) 2650 and 2655, respectively, at the other end. In one or more embodiments, in an assembled loudspeaker 100, connectors 2650 and 2655 are inserted in corresponding holes in the rear housing portion (not shown) and lock into place by means of metal tab portions on the sides of the connectors, as is known in the art. In one or more embodiments, when installed in the rear housing portion, connectors 2650 and 2655 extend into mounting channel 200 such that they engage corresponding connectors 2430 and 2425 (shown in FIG. 26 disembodied from any speaker mount to help show their interaction with connectors 2650 and 2655) of a corresponding wall mount when loudspeaker 100 is mounted to the speaker mount, as described above.

Thus, a novel loudspeaker system comprising a loudspeaker and mating speaker mounts has been disclosed. Besides offering a more convenient manner to mount and wire surface mount speakers, the present invention allows division of the installation process into tasks that are easily allocated among conventional divisions of trade between, for example, a building contractor and an AV ("audio video") installer. For example, the contractor is commonly responsible for installing in-wall wiring and junction boxes, while the AV installer is responsible for installing the speakers thermselves, as well as making electrical connections to the speaker. In an example installation process, the contractor would run the wires through the wall to a junction box affixed to a wall stud and create an appropriate opening in the wall surface (i.e. drywall) adjacent to the junction box. The AV installer would attach the speaker mount to the junction box, connect the in-wall wires to the speaker mount electrical connectors, and mount the speaker on the mount.

Although the present invention has been described with respect to certain specific embodiments, it will be clear to those skilled in the art that the inventive features of the present invention are applicable to other embodiments as well, all of which are intended to fall within the scope of the present invention. For example, although specific configurations of a loudspeaker have been disclosed, it will be understood that the invention is not limited to any particular size, shape, capacity, or type of loudspeaker. Further, although speaker mounts have been described that are configured to be mountable to a surface such as a wall or to an electrical junction box, speaker mounts incorporating the inventive features of the invention can be configured to be free standing or to mount to any type of surface, item, or object, and can be configured to provide electrical connections, including in-wall, exposed, and wireless connections to any type of audio source, including portable or mobile devices. In addition to or instead of providing electrical connections for audio signals, the mating mounting structures of the loudspeaker and speaker mount can provide additional and/or other types of electrical connections, such as, for example, power or network communications connections. Although embodiments have been described in which one speaker mount is used to mount one loudspeaker, for large loudspeakers, more than one speaker mounts may be used for a single loudspeaker. Although embodiments of the loudspeaker and speaker mount of the invention have been described as each having one mounting structure, the loudspeaker and speaker mounts can each have multiple mounting structures that allow attachment to the other at different positions or orientations. Although the mating mounting structures of the present invention have been described as being used for loudspeaker systems, other types of objects may use the mating mounting structures of the invention. Although particular configurations for the mating mounting structures for a loudspeaker and a speaker mount have been described, any other configuration can be used that provides a positive engagement of the loudspeaker with the speaker mount and that provides an electrical connection between the loudspeaker and the speaker mount when the loudspeaker is engaged with the speaker mount. Also, although a particular configuration of a "hidden" locking mechanism has been disclosed, any other configurations as will be apparent to those skilled in the art can be used.

The invention claimed is:

1. A loudspeaker system comprising a loudspeaker and a speaker mount, said loudspeaker comprising a flexible perforated speaker grille comprising a pattern of holes, said loudspeaker and speaker mount comprising cooperating mounting structures configured such that when a mounting structure of the loudspeaker engages a mounting structure of the speaker mount, the loudspeaker is supported by and electrically connected to said speaker mount; said loudspeaker system further comprising a releasable locking mechanism for positively engaging said loudspeaker with said speaker mount; wherein said releasable locking mechanism comprises a plunger disposed entirely behind said speaker grille, said speaker grille being deformable so that said plunger is activated if a portion of said speaker grille adjacent to said releasable locking mechanism is depressed; said plunger configured to release said releaseable locking mechanism when activated.

2. The loudspeaker system of claim 1 wherein a first of said cooperating mounting structures comprises a recessed mounting channel configured to engage a second of said cooperating mounting structures.

3. The loudspeaker system of claim 2 wherein said first of said cooperating mounting structures comprises said mounting structure of said loudspeaker.

4. The loudspeaker system of claim 1 wherein said speaker mount is configured to attach to an electrical junction box having a first mounting screw separation.

5. The loudspeaker system of claim 4 wherein said speaker mount is configured to attach to an electrical junction box having a second mounting screw separation.

6. The loudspeaker system of claim 1 wherein said loudspeaker comprises a plurality of mounting structures.

7. A loudspeaker comprising a first mounting structure configured to engage a second mounting structure of a speaker mount, said first mounting structure comprising first electrical contacts configured to engage second electrical contacts of said speaker mount, said loudspeaker comprising a perforated flexible speaker grille comprising a pattern of holes, said loudspeaker further comprising a releasable locking mechanism for positively engaging said loudspeaker with said speaker mount; wherein said releasable locking mechanism comprises a plunger disposed behind said speaker grille; said speaker grille being deformable so that said plunger is activated if a portion of said speaker grille adjacent to said releasable locking mechanism is depressed; said plunger configured to release said releaseable locking mechanism when activated.

8. The loudspeaker of claim 7 wherein said first mounting structure comprises a recessed mounting channel configured to engage said second mounting structure.

9. The loudspeaker of claim 7 comprising a plurality of mounting structures.

10. The loudspeaker of claim 7 wherein said first mounting structure comprises a recessed mounting channel.

11. The loudspeaker of claim 7 wherein said speaker mount comprises a mounting surface configured to attach to an electrical junction box having a first mounting screw separation.

12. The loudspeaker of claim 11 wherein said mounting surface is configured to attach to an electrical junction box having a second mounting screw separation.

13. The loudspeaker of claim 7 wherein said speaker mount is configured so as to maintain said loudspeaker at a first orientation with respect to a mounting surface.

14. The loudspeaker of claim 13 wherein said speaker mount is configured so as to maintain said loudspeaker at a second orientation with respect to said mounting surface.

15. The loudspeaker of claim 7 wherein said speaker mount is configured so as to maintain said loudspeaker at a plurality of orientations with respect to a mounting surface.

* * * * *